United States Patent [19]

Lerner et al.

[11] Patent Number: 4,781,786

[45] Date of Patent: Nov. 1, 1988

[54] TAPE SEALING RANDOM HEIGHT CARTONS

[75] Inventors: Joseph S. Lerner; David Krukas, both of Kings Park, N.Y.

[73] Assignee: The Loveshaw Corporation, Ronkonkoma, N.Y.

[21] Appl. No.: 44,884

[22] Filed: May 1, 1987

Related U.S. Application Data

[63] Continuation-in-part of Ser. No. 378,827, May 17, 1982, abandoned.

[51] Int. Cl.[4] ..... B31B 1/72

[52] U.S. Cl. ..... 156/468; 53/137; 156/477.1; 156/486

[58] Field of Search ..... 156/468, 475, 486, 522, 156/477.1; 53/137

[56] References Cited

U.S. PATENT DOCUMENTS

| | | | |
|---|---|---|---|
| 2,799,419 | 7/1957 | Scheib | 156/477.1 X |
| 3,954,550 | 5/1976 | Patterson | 156/486 X |
| 4,052,240 | 10/1977 | Luhman et al. | 156/570 X |
| 4,537,649 | 8/1985 | Ulrich et al. | 156/468 |
| 4,554,042 | 11/1985 | Marchetti | 156/468 |

*Primary Examiner*—David Simmons

*Attorney, Agent, or Firm*—George J. Brandt, Jr.

[57] ABSTRACT

Machine for taping cartons of shorter height ranges and taller height ranges. One upper taping cartridge is used for the shorter height cartons, whereas, at that time the taping arms of a lower cartridge are retracted. When a taller height carton is to be taped, the lower cartridge arms are released for taping purposes and they with the upper cartridge are used to tape the taller height carton.

16 Claims, 10 Drawing Sheets

TAPE SEALING RANDOM HEIGHT CARTONS

This is a continuation-in-part of application Ser. No. 378,827 filed May 17, 1982, now abandoned.

BACKGROUND OF THE INVENTION

Various types of machines for tape sealing shipping cartons are known. Generally, such machines apply and press separate runs of sealing tape (most commonly a pressure-sensitive type) longitudinally from the carton front end, along the top and/or bottom side, and then onto the carton rear end. A machine which seals cartons at both top and bottom sides thereof and with tape applicator means disposed at the top and bottom sides of the carton travel path is, e.g., described in commonly owned U.S. Pat. Nos. 4,028,865 and 4,041,675. Such machines are suitable for tape sealing rectangular cartons of a wide range of carton heights, since the top tape applicator means is mounted on a vertically adjustable head beam to accommodate positioning same in correspondence to a given carton height. These machines are not, however, suited for tape sealing shallow depth cartons since tape securement at the front and rear ends of short height (e.g., ½" to 2¼" high) cartons, if at all possible, would be poor and the carton easily could become opened during handling subsequent to taping.

Cartons in which the foregoing problem can be encountered are one-piece folders and mailers, e.g., book-mailer boxes or cartons, slotted document envelopes, etc. These cartons have very short heights as noted above so that tape sealing of such a shallow depth carton, and which insures proper anchorage of the initial and terminal lengths of the tape run, desirably follows a course in a wraparound at both the front and rear of the carton and along the top since these types of cartons are formed from a one piece blank and therefore have fold down abutting flaps which require sealing only on the top. Machines which can tape shallow depth cartons are disclosed in U.S. Pat. Nos. 2,083,257 and 4,052,240 but these patented machines have drawbacks. For example, the machine of U.S. Pat. No. 2,083,257 is of very complicated construction and uses a cumbersome elevating and retracting brush carrier to wipe initial and terminal tape lengths to the underside of the mailer. The machine of the U.S. Pat. No. 4,052,240 requires that carton travel through the machine be stopped to tape the terminal tape length around the corner formed by the rear wall and bottom.

A more significant shortcoming of the machines of the U.S. Pat. Nos. 2,083,257 and 4,052,240 patents is that such machines cannot readily be used for taping cartons of random heights and over a wide range of carton heights. Mailer type cartons (shallow depth) will be taped in a continuous tape run wrapping around from top to bottom at the carton ends and along the carton length at the top as illustrated in the two patents aforesaid. Taller height cartons (above 2¼" and up to heights of 20" or more) on the other hand have infolded flaps at both the top and bottom which require taping and hence, are taped with separate courses at the top and bottom and in tape runs that respectively run down and up the front and rear ends of the carton. Thus, and as illustrated in the disclosures of U.S. Pat. Nos. 4,028,865 and 4,041,675, there is a full sealing span of longitudinally directed tape at the bottom of the carton which is especially important to insure against carton flap opening at the bottom under the imposed load of the carton contents after the carton is sealed and then shipped by the user to its intended end destination. While the machines of the U.S. Pat. Nos. 2,083,257 and 4,052,240 patents may have a certain adjustability regarding taping cartons of different heights, that adjustability and hence the sizes of cartons which can be taped therewith is limited. In any event that taping function with these machines is the same for all carton heights, i.e., the taping course is the same and there is no continuous length of tape applied at the carton bottom. Thus the machines disclosed in all of the patents mentioned above, lack capacity or adaptability for use in tape sealing shallow depth cartons with a single wraparound tape run on the one hand, and on the other hand taller height cartons with two separate continuous tape runs one at the carton top and the other at the carton bottom, which different taping courses represent the most optimized taping for the different sizes of the cartons involved.

SUMMARY OF THE INVENTION

An object of the present invention is to provide an improved machine having a dual taping capacity for tape sealing shallow depth cartons in one way and taping taller height cartons in still another way, taping always occurring while the carton is traveling continuously without any stoppage thereof in a forwardly moving direction in the machine.

Another object is to effect tape sealing of a shallow depth traveling carton with a tape course extending at both the top and bottom broad sides of the carton with a tape applicator which is disposed at or operable from only one of such sides, e.g., the top side, but yet-effective to apply tape pressing at the other side, i.e., at the bottom of the carton.

A further object of the invention is to provide a machine which can be used for tape sealing taller height cartons over a wide range of such heights.

A still further object is to provide a tape sealing machine which operates by presence of entry thereto of a carton of any random carton height to automatically adjust for taping in correspondence to that carton height, effects taping and then automatically restores itself to readiness orientation for taping the next carton.

Other objects of the invention will be made clear from the description of the invention to be given hereinafter.

In accordance with the invention, the taping machine for sealing cartons comprises a machine base which mounts a lower taping cartridge and an endless conveyor belt assembly for transporting a carton received thereon at an entry end and conveying it through the machine for tape application to the carton. A vertically adjustable power operated elevator assembly including a head beam which carries an upper taping cartridge is mounted on a fixed mast at the rear of the base and the head beam positioned over the carton travel course so that the beam and hence upper taping cartridge can be moved vertically toward and away from the lower taping cartridge in correspondence to the spacing relationship alterations required between the tw taping cartridges when taping cartons of random heights.

The taping cartridges each include a pair of a movably mounted tandemly operating tape applying arms biased to normally extend into the carton travel course and when extended a first arm of each pair is so positioned as to present the adhesive face side of pressure sensitive tape from a stock thereof in confrontation to the front edge of an advancing carton so that when the advancing carton strikes the tape, same will be applied to the carton front end, the continued advance of the carton causing the arm pairs to retract. As the upper cartridge arms retract, tape is applied by them to the top of the carton, and the retracting arms of the lower cartridge apply tape to the bottom of the carton. The machine operates in two different modes, i.e., one mode wherein it tapes cartons in a range of shorter heights (up to 2¼") and in a second mode wherein it tapes cartons in a range of taller heights (above 2 ¼"). In the first mode the arms of the lower cartridge are automatically retracted to a non-taping disposition thereof so that taping is effected only by the arms of the upper taping cartridge. In that first mode, the second arm of the upper cartridge pair on extending from retracted position in response to release of the constraint thereon by passage of the carton beyond the point at which the retracted second arm was in tape pressing engagement with the carton top, will press tape onto the carton rear end and in wraparound from the rear end forwardly a distance on the carton bottom, all as the carton continues to travel forwardly on the conveyor. For such purpose, the second arm carries a tape pressing member articulated thereto, the tape pressing member comprising an angularly profiled bracket having two leg parts, one of which is pivoted to the second arm and the other of which carries a carton engageable pressing device such as a roller. First machine mode operation results in application to the carton of a single continuous tape course in wraparound from bottom to top at both the front end and rear end of the carton with the course extending along the top of the carton between the two ends. An initial course tape length at the front underside of the carton represents a tape length that extends below the carton travel course at first engagement of the carton front end with the tape feed and which initial length trails below the carton as it is passing under the upper taping cartridge. This initial length is lapped against the carton bottom by a wiping roller carried on the machine base immediately downstream from the upper taping cartridge.

When the machine is operating in the second mode associated with taping taller height range cartons, the second arm of both the upper and lower taping cartridge pairs when moving to extended position, pass tape onto the carton rear end, the upper cartridge second arm wiping tape downwardly at the rear end and the lower cartridge second arm wiping tape upwardly. With regard to a carton having a height in the lower end of the taller carton height range, the application of tape to the carton front and rear ends can involve overlap of tape from one course on that of another since the lower cartridge is spaced downstream some distance from the upper and the respective arms of said cartridges thus are in contact with the carton front and rear ends at different times. There will be no such overlap on cartons in the middle and upper end of the taller height range and the terminni of each of the two separate tape courses applied by the machine to such cartons will be at vertically spaced locations on the carton front and rear ends.

The operation of the machine is fully automatic upon entry of a carton of any one of random heights onto the conveyor and all following sequences of taping events and machine operation are controlled by the carton presence and travel through the machine. When a carton enters on the conveyor, a detector carried on the head beam senses the carton height and initiates two functions. One, it causes the elevator assembly to elevate from a non-taping home or bottomed position and locate in a vertical position corresponding to the detected height of the carton, and two, it initiates operation of side rails in the base to move them from a laterally remote position to bring them into side guidance embrace with the carton so that it will be guided and properly centered as it passes through the machine on the conveyor. In conjunction with the elevation of the head beam, if this occurs to an extent associated only with taping of a shorter height range carton, the lower taping cartridge arms will remain retracted in non-taping position by reason of presence of air pressure acting on an arm retraction cylinder unit connected with the arms and since a control switch on the mast is held in positioning thereof by the head beam which insures this. On the other hand, if the head beam elevates to a position to accommodate a taller height carton, its upward movement beyond a height elevation which represents maximum shorter carton height, will alter the control switch positioning such as to cause the cylinder unit to be deenergized and the arms of the lower cartridge will by imposed spring bias move to extended position in the carton travel course.

When the head beam has moved up to accommodate the carton and the carton moves forwardly, it will engage a switch on the machine base that terminates power control of the the elevator assembly and the head beam will rest by gravity imposed force on top of the carton. On moving forwardly, the carton closes a switch that disables the power drive of the elevator assembly so that during passage of the carton through the machine the elevator assembly cannot "jump" in the event an upturned part of a carton flap should strike the detector. Following completion of taping, the carton leaves the machine at which point other carton travel actuated switches will operate to cause slight and momentary power lifting of the head beam to a carton off-feed clearance position followed then by return of the head beam to its home position.

With the head beam in shorter height carton taping mode, the first or tape presenting arm of the upper cartridge unit extends a distance below the carton travel course and positions an initial length of the tape presented therewith a corresponding distance below the carton travel course. This means that the front end of the advancing shallow depth carton will engage the tape length part immediately above such initial tape length and that initial length will thereafter be carried along at the carton bottom as a trailing tape length to subsequently be lapped against the carton bottom. But to insure that such initial tape length remains squared relative to the advancing carton before the carton front edge strikes the tape length part immediately above, and to obviate any effect that could wrinkle or otherwise disorient the intended disposition of same relative to the carton, such as the effect of static electricity present in the machine, that initial tape length will automatically be held until the carton front end has engaged the tape length part above it. This is done with a plunger unit located in the base adjacent the conveyor entrance end. Immediately downstream of the switch which effects isolation of power control of the elevator assembly, is a plunger control switch actuated by the carton and effective to cause forward stroking of the plunger of the plunger unit from a set position thereof so that the plunger will strike the adhesive face of the tape initial length and thus hold it until the carton has engaged the length part above and then pulls the initial length face adhered to the plunger away from the plunger as the carton advances therebeyond. The plunger unit always strokes forwardly shortly after a carton of any height enters the machine but in the instance where the carton is one in a taller height range, it will have no tape holding function since the initial length of tape presented by the upper cartridge arm will have been elevated to a position beyond the reach of the plunger.

Tape cutters for cutting the tape sealing course lengths of tape from their associated tape stocks are provided in each taping cartridge. These tape cutters are movably mounted and the advancing carton retracts them as it passes along past the cartridges. Upon travel of the carton rear end beyond the contact point with the retracted cutter, the cutter extends under an imposed bias force and severs the requisite tape length.

The invention accordingly comprises the features of construction, combination of elements and arrangements of parts of the tape sealing machine which will be exemplified in the construction hereinafter set forth and the scope of the invention will be indicated in the claims.

BRIEF DESCRIPTION OF THE DRAWINGS

A fuller understanding of the nature and objects of the invention will be had from the following detailed description taken in conjunction with the accompanying drawings, in which.

Throughout the following description, like reference numerals are used to denote like parts in the drawings.

DESCRIPTION OF THE PREFERRED EMBODIMENTS

Figure 1:
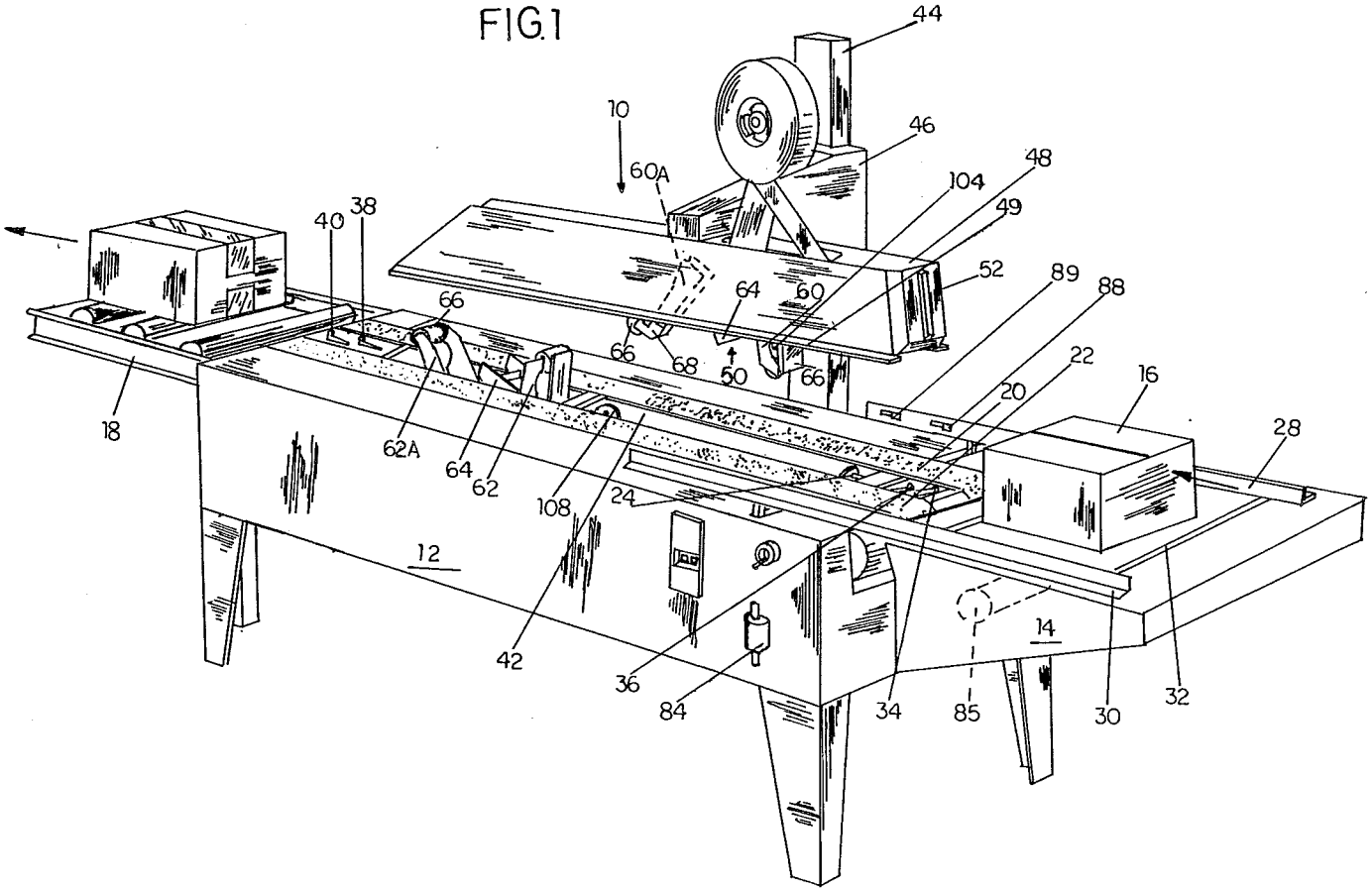
FIG. 1 is a perspective view of a taping machine for taping sealing random height cartons constructed in accordance with the principles of the present invention, the machine being depicted for purposes of clarity with the head beam elevated to a position which it occupies when taping a taller height carton and the arms of both the upper and lower taping cartridges being in extended position such as to lie in the carton travel path.

Referring to FIG. 1 of the drawings, the taping machine 10 shown therein has certain construction similarity with the machines shown in commonly owned U.S. Pat. Nos. 4,028,865 and 4,061,526 to the extent that the U.S. Pat. No. 4,028,865 patent discloses a vertically adjustable head beam assembly having some features like those used in machine 10, and U.S. Pat. No. 4,061,526 shows general constructional details of a taping cartridge mounting tandemly operated taping arms carrying taping rollers at the ends thereof and like the cartridges used in machine 10. The disclosures of these patents are incorporated herein by reference.

Reverting to FIG. 1, the machine 10 includes as components a base 12 having an entry end at which can be located a carton feed-in table 14 for reception of a carton 16 which requires taping and by means of which the operator can push the carton into the machine for taping. The table can be a structure common with base 12 or it could be a separate unit positionable alongside the base so as to extend the siderails 28, 30 carried thereon along the course a carton will travel through the machine. A carton off-loading roller table 18 can be provided at the discharge end of the machine for takeaway of the taped carton. The base includes a carton receiving conveyor provided as a pair of spaced apart forwardly travelling endless conveyor belts 20, 22 and onto which an operator will push a carton from table 14 to initiate the taping handling of the carton. The conveyor belts transport the carton through the machine along a travel course defined by the conveyor belts, the lateral machine spacing between the conveyor belts serving, inter alia, to accommodate near the entrance end, a plunger unit generally shown at 24, a downstream located lower taping cartridge shown generally at 26 and the laterally opposed side rails 28, 30 extending forwardly from table 14, these side rails serving to guide the carton as it travels through the machine, the side rails for depiction convenience being shown in their laterally remote positions but being movable slidably inwardly in slots 32 of table 14 to closely embrace the travelling carton. Base 12 also mounts at the entrance end a pair of carton actuatable switches 34, 36 slightly longitudinally spaced apart to provide a time delay sequencing function as will be described later. A like pair of longitudinally spaced switches 38, 40 are also found on the base at the discharge end. Immediately downstream of the plunger unit 24 is the space 42 in the base wherein the arms of an upper taping cartridge will locate when the head beam to be described next is in a home position.

Mounted at the rear side of the base is a mast 44 which carries a movable elevator assembly thereon, the elevator assembly including a forwardly directed bracket 46 vertically movable along the mast and which carries a head beam 48, the head beam in turn carrying the upper taping cartridge shown generally at 50. A paddle switch assembly 52 is mounted on the entry end of the head beam and is employed to detect carton height and therewith control head beam positioning in a manner similar to as described in U.S. Pat. No. 4,028,865 but with certain differences and improvement as will be described in detail later. The upper taping cartridge includes a mounting post 54 for holding a stock of pressure sensitive tape 56. A like stock of tape is provided in cartridge 26.

In the FIG. 1 position, the machine is shown in a taping mode for taping a carton in a taller height range and thus the head beam is shown positioned some distances above the base although it will be understood and as will be apparent from later description, orientation to such mode will involve presence of the carton 16 at the right end of the head beam inasmuch as such presence is required for the paddle switch assembly 52 to make height detection and initiate head beam elevation to the FIG. 1 position from home position to accommodate the carton.

Figure 7:
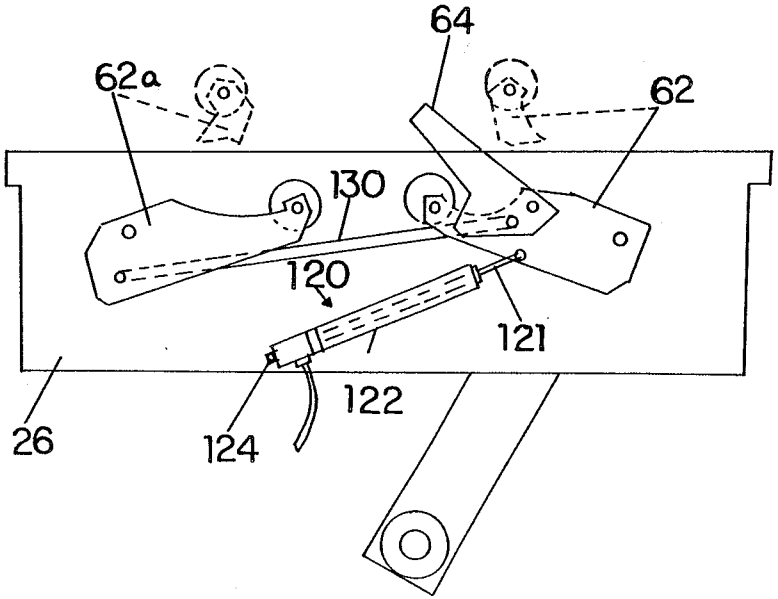
FIG. 7 is a fragmentary elevational view of the lower taping cartridge illustrating how the arms thereof are held retracted out of taping position by a pneumatic ram unit whenever a shorter height carton is being taped with the upper taping cartridge only, the arms of the lower cartridge when extended for taping a taller height carton being shown in dashed lines.

The lower taping cartridge 26 and the upper taping cartridge 50 each include a pair of movably mounted, i.e., pivoted tape applying-tape pressing arms. These arms are such as to have tandem operation, i.e., they are connected together to extend and retract as a unit in the manner and by means as exemplified in U.S. Pat. No. 4,061,526. Since they are normally under the imposed bias of a spring member, the arms of both cartridges will extend into the carton travel course where taping involves a taller height range carton. Where a shorter height range carton (shallow depth) is to be taped and as will be discussed later, the arms of the lower cartridge 26 will automatically have been moved to a non-taping position as shown in FIG. 7 and only the arms of the upper cartridge will extend into the travel course.

Figure 6:
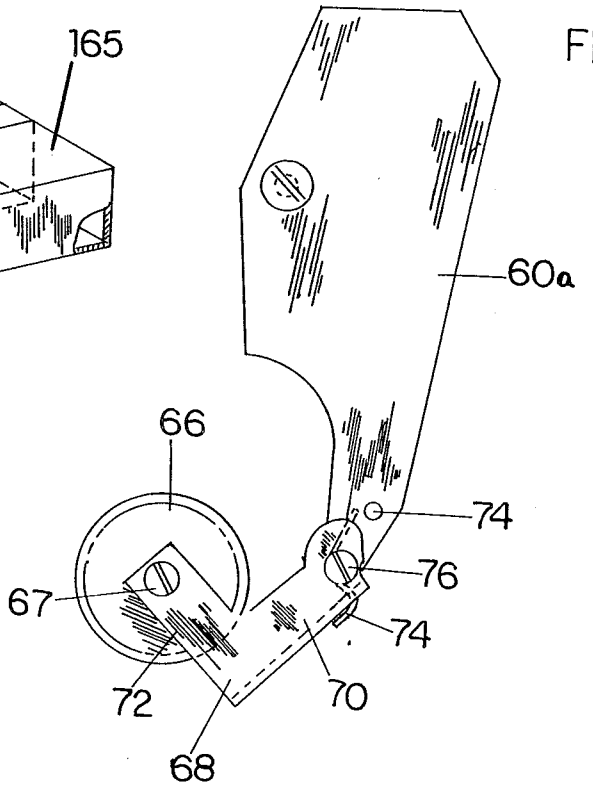
FIG. 6 is a side elevational view of the tape pressing member which is articulated to the upper cartridge second arm showing constructional features thereof.

Each taping cartridge has a first taping arm, designated 60 for the upper cartridge and designated 62 for the lower cartridge. The respective second arms are designated **60*a* and 62*a* respectively. Each cartridge also carries positioned between its two arms, a tape cutter 64 pivoted in the cartridge and under a spring bias that projects it in a cutting direction towards the carton travel course. When the carton by its forward travel engages the cutter it will cause the cutter to retract until the carton travels beyond to release the cutter at which point it will move in cutting direction to sever a length of tape from the stock thereof. The tape cutter 64 for the lower cartridge can be seen in detail in FIG. 7. Each of arms 60, 62 and 62*a* which are pivoted at the corresponding one end of each, carries a tape pressing roller 66 at the other or tip end of the arm. Arm 60*a* which is also pivoted at one end carries, on the other hand, a profiled bracket 68 (FIG. 6) articulated to its tip end, the bracket having a first leg 70 pivoted to the arm and a second leg 72 which carries a roller member 66 on pivot 67. A torsion spring 74 is engaged around the pivot 76 connecting the bracket to arm 60*a* and engages the arm and bracket so that the bracket is biased clockwise toward the arm 60*a* as shown in FIG. 6** to to normally nest closely adjacent the arm as will be explained in more detail later and with reference to FIGS. 5A–5D.

Figure 2:
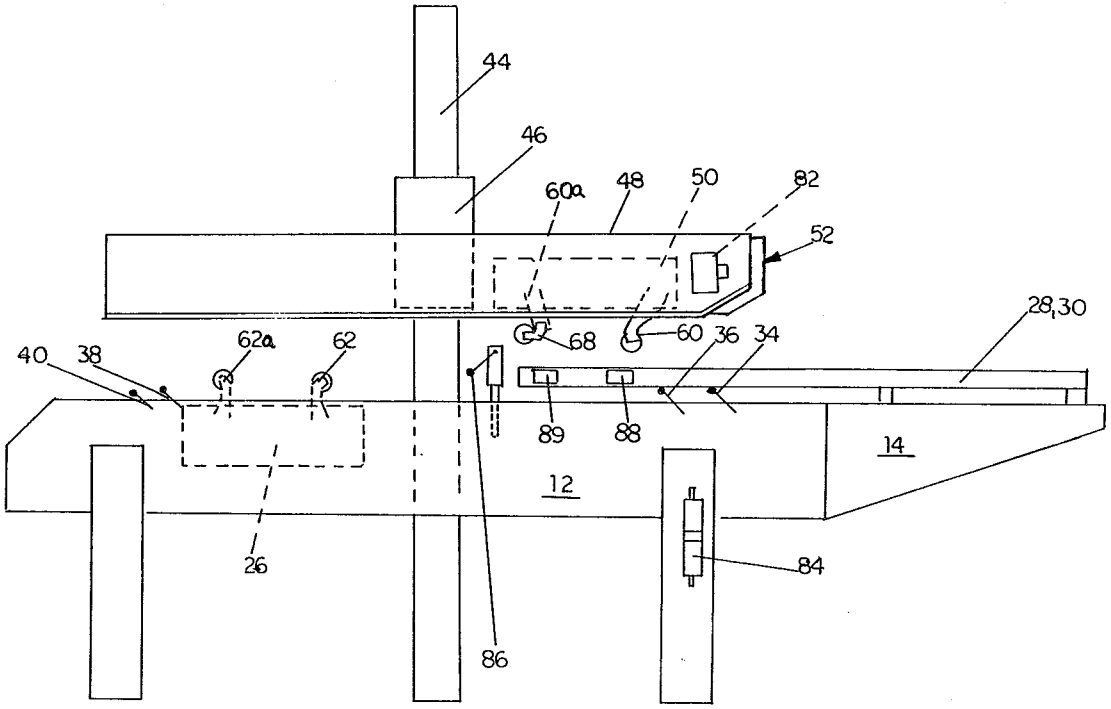
FIG. 2 is a longitudinal side elevational view diagrammatically showing the machine general arrangement and the location of various of the switches and like controlling devices embodied therein, certain machine elements being omitted from purposes of clarity of depiction.
Figure 3:
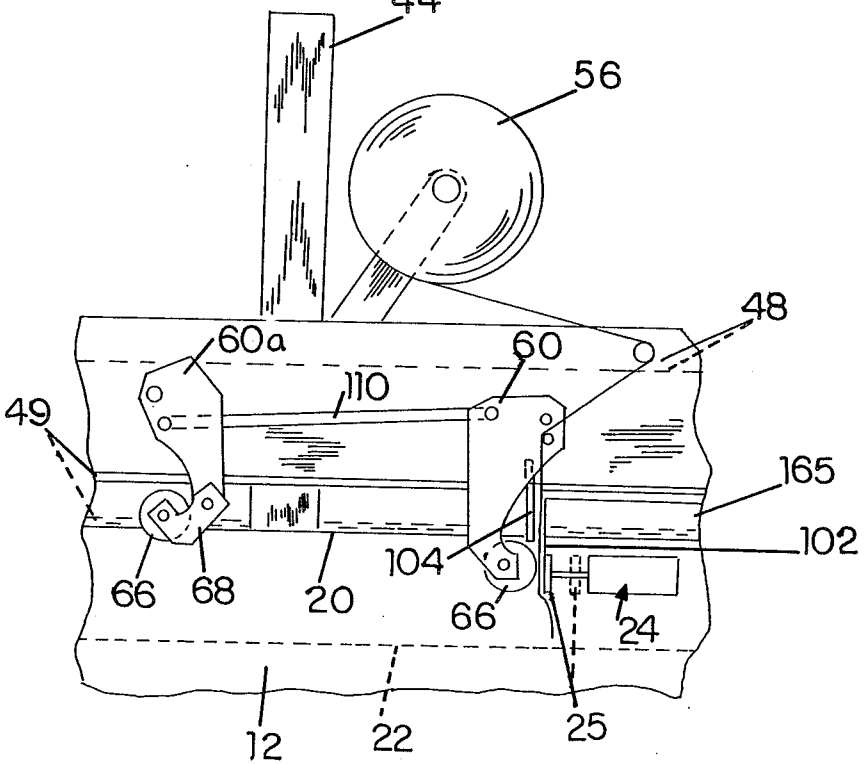
FIG. 3 is a fragmentary elevational view similar to FIG. 2 showing the beam head home position in dashed lines, the full line position thereof being an elevated one incident carton taping a carton of shorter height, with the arms of the upper cartridge unit shown extended, the first arm disposing an initial length segment of tape below the carton travel course where the plunger unit can hold such initial length in shallow depth carton sealing mode, the lower taping cartridge not being shown.
Figure 8:
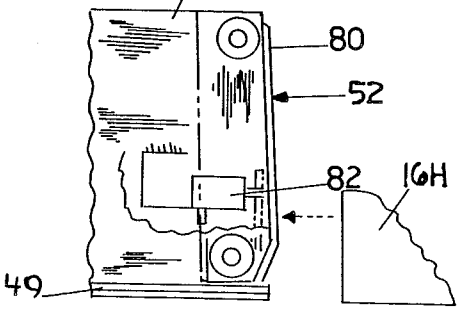
FIG. 8 is a fragmentary elevational view partly broken away showing the switch and controlling device mounted on the head beam entry end which senses carton height and initiates head beam elevation from home position and which also causes machine side rails to embrace the carton.
Figure 9:
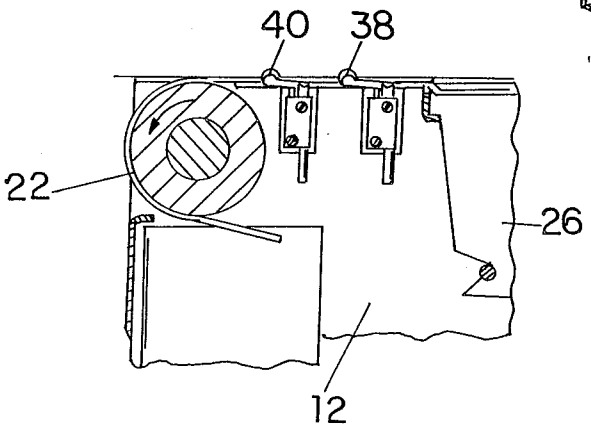
FIG. 9 illustrates in partial elevational sectional form, the discharge end of the machine.

Referring to FIGS. 2, 8 and 9, description will be given of the various switches and controlling elements employed to fulfill the machine operating functions and which it will be noted is a carton presence and travelling occurrence through the machine which produces the sequences of steps involved in taping, the taping being carried out while the carton is in non-stop passage travel through the machine. It will be understood that machine powered operations are effected with pneumatic devices inclusive of pneumatic cylinder units, air valves, pneumatic switches etc. However other motive means such as hydraulic units, electric motor drive etc. also could be used as those skilled in the art will understand. When the carton enters onto the conveyor, the machine will be in a machine non-taping mode, i.e., head beam 48 will be in the homed location thereof wherein its bottom skirt 49 is about ½" above the conveyor belts 20, 22 and the arms of the upper taping cartridge will position below the travel course as seen in FIG. 3. With the head beam in home position, the arms of the lower taping cartridge will be retracted by a pneumatic cylinder unit as shown in FIG. 7 and more details of which will be given later. The FIG. 2 position of the head beam 48 is elevated some distance as would correspond to a taller height range carton and the lower cartridge arms will in that mode be extended by events as will be given below.

Figure 10:
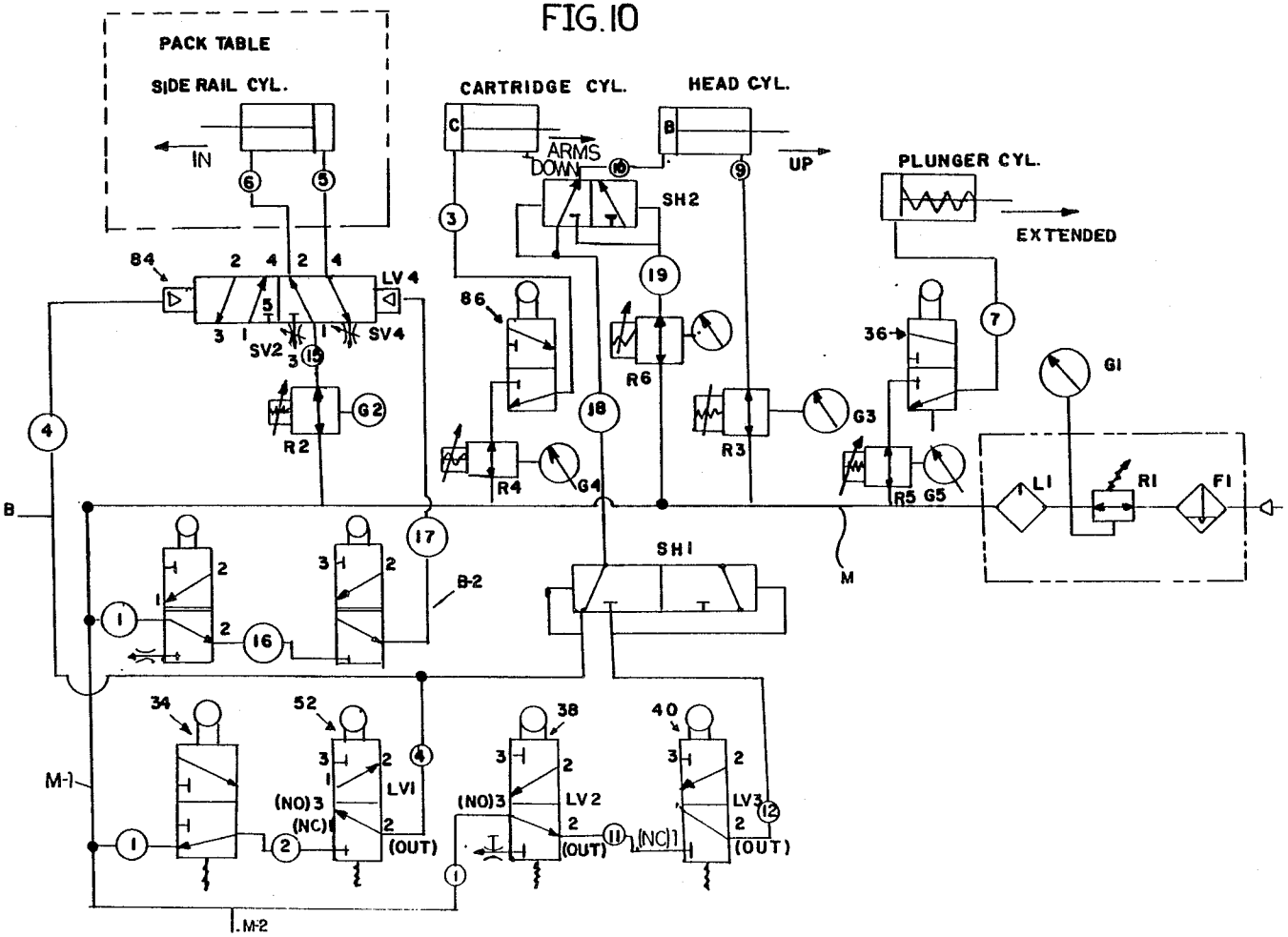
FIG. 10 is a pneumatic circuitry diagram of the pneumatic operating cylinders and controls thereof employed for machine operation.

When carton 16 is fed from roller table 14 onto the conveyor belts 20, 22 its front end regardless of carton height will engage the right end of the head beam and more specifically the paddle switch assembly 52. That engagement will as seen in FIG. 8 pivot the paddle arm 80 leftwardly causing the core 82 therein to control pneumatic circuitry (as shown in FIG. 10) that will produce two functions. The air cylinder controlling the elevator assembly is operated to cause the head beam to elevate and draw the side rails 28, 30 laterally inwardly alongside of the carton. It will actuate double pilot valve 84 such that the air cylinder 85 controlling the side rails is operated. When the head beam has raised high enough to give the carton clearance forward travel passage therebelow, the carton will start travelling forwardly, paddle arm 80 is no longer engaged and air to the elevating cylinder stops and the head rests by gravity on the carton. Immediately this carton forward travel will result in the carton actuating switch 34 which will disable or prevent further power operation of the elevator assembly. Shortly downstream the carton will close switch 36 and this will result in forward stroking of plunger unit 24 (FIG. 3) from its set position. If the carton is a shorter range height carton the plunger 25 will hold an initial length of tape presented by upper cartridge arm 60 as the tape adhesive base adheres to the plunger. If it is not, the tape presented by arm 60 will before the plunger is stroked forwardly have been elevated and be located a distance above the reach of the plunger. As the head beam adjusts vertically to accommodate a particular carton height, that vertical adjustment will in correspondence to the detected carton height serve to maintain retraction or release of the retraction of the arms of the lower taping cartridge by means of switch 86 mounted at the back of the base 12, e.g., on the mast 44. Movement of the head beam vertically in the shorter carton height range will not affect the switch 86. If however, it moves above that shorter height range to accommodate a taller height range carton, switch 86 will be actuated (by bracket 46 movement) with the result that the retraction cylinder associated with the lower taping cartridge arms will be deenergized and the arms 62, 62*a* will spring bias extend into taping position in the travel course. It will be noted that for a shallow height carton only the taping arms of cartridge 50 are employed, whereas, when a taller height carton is being taped, the arms of both cartridges are used.

When the carton rear end in passing through the machine passes by successively positioned side rail mounted switches 88 and 89, the side rail air cylinder will be actuated to release the side rails from the carton sides and they will retract to their remote position and as will be understood with reference to FIG. 10 as will be given later. Following taping and as the carton is at the discharge end of the conveyor, the carton will strike successively switches 38 and 40 to cause a slight carton off feed clearance elevation of head beam 48 as the carton leaves the conveyor, and the elevator will therefore return by gravity to a home position. The functions of the switches 38, 40 will be understood by reference to operation of the corresponding switches 26, 27 disclosed in U.S. Pat. No. 4,027,865.

Figure 4:
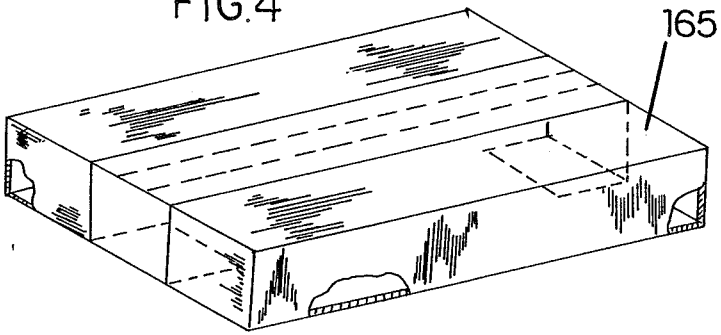
FIG. 4 is a perspective view of a shallow depth carton showing the tape seal course applied thereto by the machine of the invention.

FIGS. 3, 4 and 5A–5D depict how taping of a carton of shorter height range occurs. FIG. 4 shows the tape sealing course applied to the shallow depth carton 16S which is a mailer-type carton made from a one-piece blank and having folded flaps at the top only. The tape course illustrated is a continuous run thereof with end wraparound at both the carton front and rear and includes a segment at the carton bottom side running forwardly from a point spaced rearwardly a distance from front end wall, a segment running up the front end wall, a segment running the full length of the carton on the top side thereof, a segment passing down the carton rear wall and a segment running forwardly at the carton bottom for a distance toward the front end. The front and rear wrap around segments are required to give good anchorage for the full length top side segment of tape.

Figure 5A:
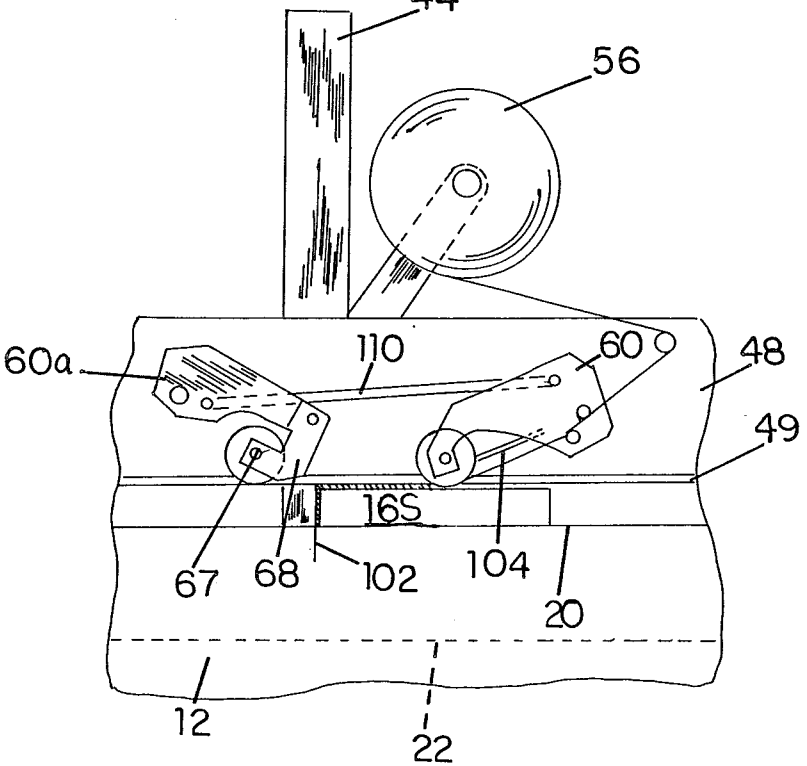
FIGS. 5A through 5D show graphically successive ones of the sequence of movements involved in the tape sealing of a shallow depth carton, i.e., a shorter first height range carton.
Figure 5B:
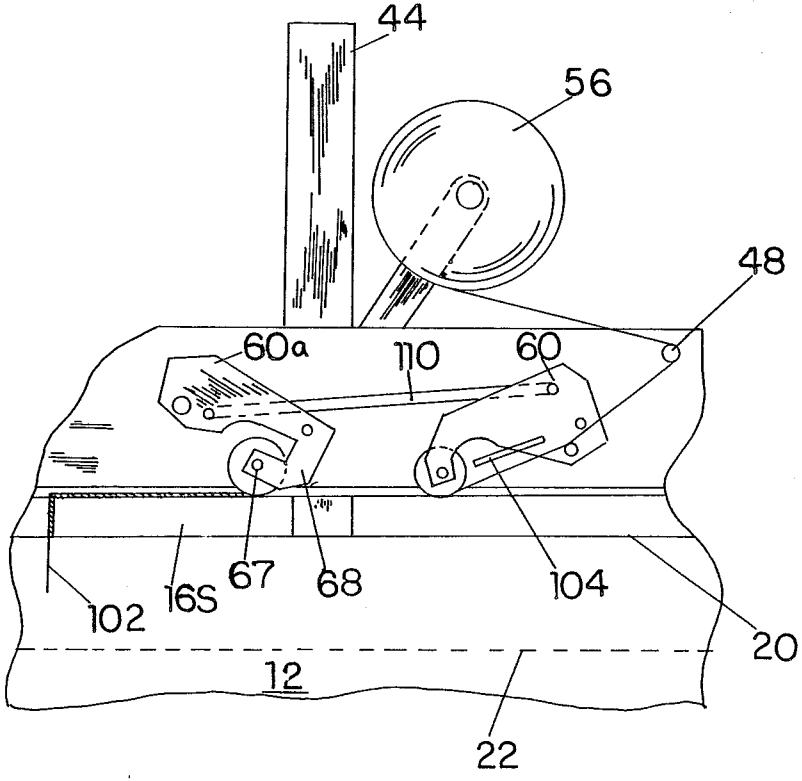

Referring to FIG. 3, the head beam 48 is positioned above the shorter height carton 16 having moved up from the home position thereof shown in dashed lines. Arms 60, 60*a* of the upper taping cartridge are in extended position and it will be noted that in such position, arm 60 locates a distance below the carton travel course and therewith locates an initial length segment 102 of the tape 56 at a corresponding location below the travel course. It will be seen that in extended position arm 60 has a greater down reach than arm 60*a*. In so disposing the initial length segment 102 of tape, which is located at the right side of roller 66 on arm 60, it will be understood that the pressure sensitive face of the tap which is presented to the advancing carton 16 for engagement thereof by the carton front end is tape length portion immediately above said initial length section and that tape length portion is backed by a plate member 104 fixed on the arm member. In FIG. 3, the carton front end is just about to strike that immediately above tape length portion. It also will be understood that the plunger 25 of plunger unit 24 has been stroked forwardly and is engaged with the initial tape length 102 to hold it as the carton front wall is making engagement in good tight pressing engagement with plate 104. This is the tape held position in this taping mode to obviate effect of static electricity on the initial length which could wrinkle or curl it and thus prevent proper ultimate lapping adhesion thereof to the carton. Tape length 102 will pull off the plunger unit as the carton continues its advance and ultimately will be lapped against the carton bottom at the front by wiping engagement with downstream roller 108. As the carton contains its forward advance it will cause arm 60 to retract counterclockwise and since it is connected by connector rod 110 with arm 60*a*, that arm also will retract, but counterclockwise. In the retracted positions of arms 60, 60*a* whey will be held in tape applying and pressing engagement with the top of the carton as shown in FIGS. 5*a* and 5*b*. Because of the presence of plate 104 as the first contact with the carton front end, the roller 66 of arm 60 will not contact the carton front end but will perform tape applying and pressing starting only on the carton top. Soon after engaging the arm 60, carton 16 will advance enough to release switch 36 and the plunger 25 will be returned to its position shown in dashed lines in FIG. 3. During retraction of arms 60, 60*a*, tape is feeding from stock 56 and onto the carton top with the rollers 66 on the two arms pressing the tape down against the carton top side infolded flaps to seal them together.

FIG. 5B shows the tape applying and pressing condition after the carton has traveled forwardly sufficiently to move the top side thereof beyond the contact of roller 66 of arm 60, but at which time tape pressing is being effected by roller 66 of arm 60*a* at the trailing or rear part of the carton top side and just prior to the point at which roller 66 of arm 60*a* will move down onto the carton rear end. In the FIG. 5C condition and while the first arm 60 is no longer in contact with the carton, such arm will not start to move from retracted to extended position in spite of the action of the tension spring (not shown but the same as described in the '526 patent) that tends to urge the tandem operated arms into normally extended position. The tandem coupling of such arms and the engagement of roller 66 of arm 60*a* with the carton top side prevents initiation of extension. No such restraint however acts on the cutter 64 which in the manner similar to as described in the '526 patent will descend to sever the tape feed leaving a sufficient terminal length of tape to constitute the tape segments to be applied to the carton rear end and bottom at the rear part thereof.

Figure 5C:
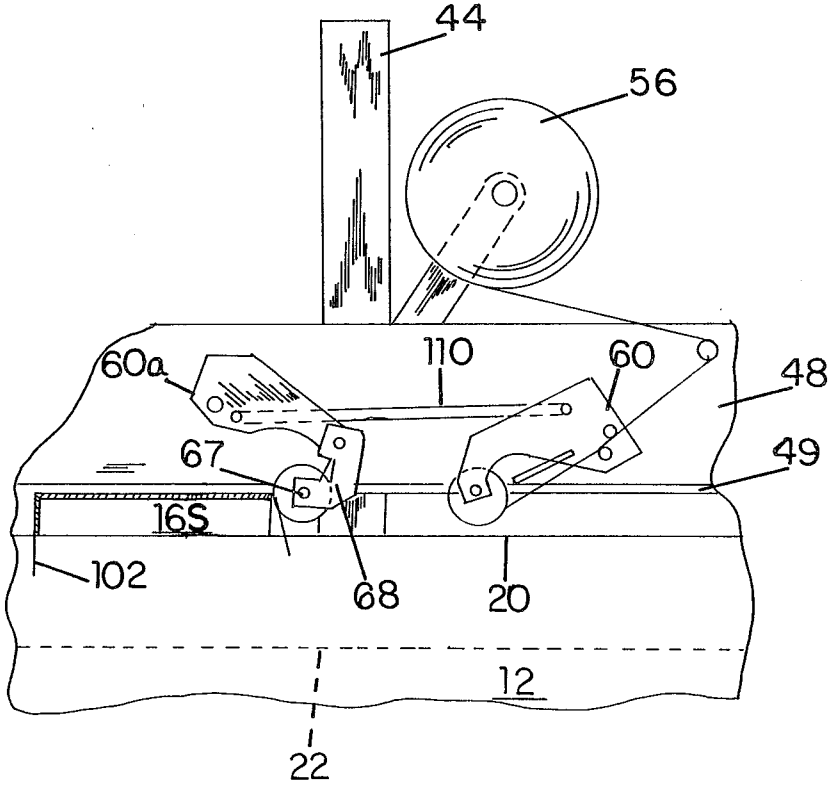

As soon as the carton travels forwardly beyond the point at which its rear end is at the point of engagement with roller 66 of arm 60*a* and as shown in FIG. 5*c*, both applicator arms will start to extend downwardly from their retracted positions. The bracket member 68 it will be noted will nest in close alongside adjacency at the forward side of the arm 60*a* when that arm is retracted but as that arm extends downwardly, the bracket will, due to the fact that is is in contact with the traveling carton coupled with the extension movement of the second arm, be caused to rotate counterclockwise and open away from arm member 60*a* in opposition to the bias of spring 74 but following due to pivoting action of arm 60*a* and rotation of bracket 68, a path of movement which maintains its associated roller 66 in constant tape pressing contact with the carton rear end. As this roller "walks" down the carton rear end there is caused a restraint in the complete extension of arms 60, 60*a* so that, e.g., as shown in FIG. 5C both arms still have some distance of respective counterclockwise and clockwise rotative movement to make before they are fully extended.

Figure 5D:
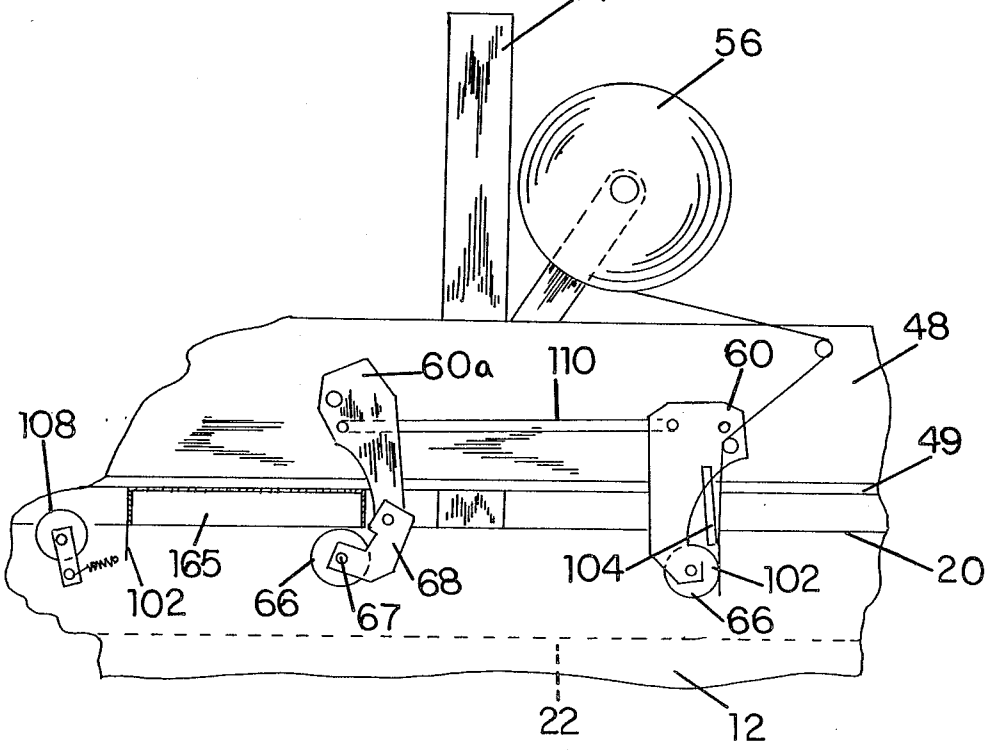

As soon as the roller 66 clears engagement with the carton rear end, i.e., when the point of roller engagement is at the carton bottom side, the restraint on full extension of the arms is released. As shown in FIG. 5D, the clockwise rotation of arm 60*a* in returning to full extension position, "throws" or propels the bracket 68 and roller 66 carried thereon forwardly at a speed greater than that at which the carton is traveling to wipe tape onto the carton bottom side, the roller "walking" around the corner formed by the carton rear end and bottom and never leaving pressing contact with the tape or carton structure. As soon as the carton rear end travels forwardly beyond roller 66 of arm 60*a*, the bracket 68 will rotate clockwise to nest alongside the fully extended now at rest arm 60*a*. The application and pressing or wipe down of the tape on the carton has been accomplished with tape pressing rollers in continuous contact with the carton, there being no interruption of pressing contact at any point during the time the forwardly moving carton is being thus taped.

When taping a carton in the taller height range, the tape courses will be two separate ones on the top and bottom of the carton and as shown on the carton discharging from the machine in FIG. 1, i.e., the two respective tape courses will extend from the front end of the carton, along the top and bottom and onto the carton rear end. In the carton taller height range taping mode, plate 104 of arm 60 will apply tape to the carton front end, roller 66 on arm 60 will pass tape onto the carton top and that arm and arm 60*a* while retracted press the tape down on the carton top. Arm 60*a* and more particularly the roller 66 pivoted in bracket 68 will as that arm 60*a* extends wipe tape down the rear end of the carton for a certain distance. The bottom taping course will be applied by the extending arms of cartridge 26. The roller 66 on arm 62 of that cartridge will present the tape that the carton engages and that roller 66 when the arms 62, 62*a* are retracted, will apply tape along the carton bottom, roller 66 on arm 62*a* cooperates to press this tape against the carton. Roller 66 on arm 62*a* will pass and press tape onto the carton rear end as that arm extends.

After the taller height carton leaves the conveyor, switches 38, 40 function for off-feed beam head clearance and the head returns to home position. In so moving to home position, the beam bracket 46 will engage and close switch 86 to cause the lower cartridge retraction cylinder to retract the cartridge arms 62, 62*a* to a non-taping position. FIG. 7 shows that pneumatic cylinder 120. The rod can be, e.g., fixed to arm 62. The cylinder thereof 122 is on the other hand connected at a fixed location as at 124 on the cartridge frame. When switch 86 is closed, air is admitted to the cylinder unit and the cylinder rod strokes to pivot arm 62 and arm 62*a* (because of tandem coupling rod 130) to rotate to retracted positions below the carton travel course where these arms cannot engage a carton traveling along that course and hence perform no taping function. Cutter 64 of the lower taping cartridge can and does project up into the carton travel course but it will pivot downwardly without effect any time a shallow depth carton advances into contact therewith.

FIG. 10 shows the circuit arrangement of pneumatic cylinders, valves etc. used for controlling the power operated components of the machine which will be described next.

With reference to 10 and further reference to FIG. 2, the workings of the pneumatic circuitry of machine 10 can be better understood. With the machine connected to electrical power and a source of pressurized air and with the head beam in home position, it will be noted that switch 86 (which like all the other switch units include the usual air valve assembly) will be oriented such, i.e., in held position by elevator bracket 46 that its core passes air from main M to stroke air cylinder unit 120 to retract and maintain the lower taping cartridge arms retracted. A carton enters the machine and strikes paddle valve 52 which shifts its core downwardly so that air can pass through that core from main M-1 (via core of switch/valve assembly 34) to pass up through shuttle SH1 and cause stroking of the head cylinder to start elevating head beam 48. When the head beam has elevated enough for the carton to pas forwardly under it, paddle valve 52 returns to off position and its core is moved up so that even though air from main M-1 can pass through assembly 34 it can not pass up to the head cylinder. The head beam being no longer powered rests by gravity on top of the carton. At the time paddle valve 52 operated, air also was passed by branch B to double pilot valve 84 and shifted it rightwardly so that air from main M was passed to the side rail cylinder to stroke the rails inwardly alongside the carton as it was pushed against the paddle valve and the head beam was elevating.

In starting through the machine at entry end, the carton depresses switch 34 and shifts its core upwardly so that air can not pass through it. This has the effect of disabling the head beam elevating cylinder since even if a bent or otherwise upstanding flap of the carton moving along under the paddle switch should strike it and cause momentary closure, the head cylinder cannot become powered and "jump up" to the detriment of the proper commencement of taping by the upper taping cartridge. After the carton advances past switch 34, it will of course position its core to the normal down shifted position. As the carton advance continues it strikes switch 36 and shifts its core to connect air from the main to stroke the cylinder of the plunger unit forwardly. The cylinder of the plunger unit which is spring loaded, will be returned to set position after the carton passes downstream beyond its holding position of switch 34.

In connection with the above described first elevating movement of the head beam, it will be remembered that if a taller height range carton is to be taped, the head beam will keep moving upwardly until it is just above the height of the carton. In moving to that height, elevator bracket 86 will have released switch 86 so that its core will shift to a position blocking air passage therethrough with the result that the absence of air in the cartridge cylinder will allow the spring bias arms of the lower taping cartridge to extend for taping at the bottom of the taller height carton.

When the carton is passing along under the upper taping cartridge, it will first strike switch 88 mounted on the side rails. This will shift the core of switch assembly 88 upwardly so that no air from main M-1 can pass through. This carton advance will immediately thereafter actuate side rail switch 89 to shift its core down so that air would pass through that core if the core of switch 88 was not blocked. As the rear of the carton passes switch 88 its core will be shifted and air from the main M-1 can now pass through its core and the core of switch 89 (still held down by the carton). This allows air to pass through branch B-2 up to the double pilot valve 84, shifting it leftwardly and orienting its core so that air is delivered to the other side of the piston in the side rail cylinder and the side rails thus become shifted to open position. As the carton is traveling at the discharge end of the machine, it will first close switch 38 moving its core so that air can not pass through it. Continued advance closes switch 40 so its core is shifted to pass air but none is available as the core of 38 is blocked. When the rear of the carton passes beyond switch 38, its core shifts to pass air and air will momentarily flow through it, switch 40 and into the head cylinder to provide a slight and momentary carton clearance raising of the head beam to permit the carton to clear off the machine unimpededly.

While there is above disclosed only one embodiment of the machine of the present invention, it will be appreciated that various modifications can be made thereto by those skilled in the art without departing from the scope of the inventive concept herein disclosed. For example, the plunger unit 24 could be mounted in a fixed beam head, the base could be vertically adjustable and the taping cartridges 26, 50 could have their locations reversed and this simple reversal of parts would accomplish the same taping as the machine embodiment described. Further, the range of shorter height cartons could be enlarged for taping cartons as with carton 16*s*, in a height range greater than $2\frac{1}{4}''$ by appropriate positioning of the switch 86 on the mast and corresponding lengthening of the arms of cartridge 50.

What is claimed is:

1. Machine for tape sealing cartons of random heights which is any one in a first range of shorter heights and a second range of taller heights while the cartons are advanced without stop along a forward travel course, the tape sealing of a shorter height carton being in a continuous wrap around tape run longitudinally of the carton from the top side to the bottom side of both the front and rear of said shorter height carton, the tap sealing of a taller height carton being in two separate continous tape runs extending longitudinally of the carton one on the top side and down a distance on the front and rear ends thereof and the other on the bottom side and up a distance on the front and rear ends thereof, the machine comprising upper and lower taping cartridges supported along the carton travel course, each cartridge including a pair of movably mounted tape applying arms having a normally extended position lying in the carton travel course, a first arm of each pair in extended position presenting the adhesive face side of pressure sensitive tape from a stock thereof in confrontation to the front end of an advancing carton so that the advancing carton can engage the tape to apply it to the carton front end and with its advance draw out tape run from the stock while additionally moving the first arm to a retracted position, the second arm of each pair being connected to its associated first arm to retract in tandem therewith, the first and second arms of the upper cartridge when retracted being in tape pressing contact with the top and those of the lower cartridge when retracted being in tape pressing contact with the bottom of the advancing carton, the upper and lower cartridge second arms when extending from their retracted positions pressing tape onto the carton rear end on forward pass by of the said rear end of the points where the retracted second arm of the respective pairs is in tape pressing contact with the carton to and bottom, means at the entrance to the carton travel course for detecting the height of a carton, means operable responsive to the detection of carton height to vertically adjust the spacing between the upper and lower taping cartridges in correspondence to the height of the carton, means operable whenever the detected carton height is one within said first height range to retract the arms of said lower taping cartridge to a position beyond that which is caused by carton engagement with said arms whereby the arms of said lower cartridge locate in and maintain a carton non-engaging, non-taping mode during the pasasge of a first height range carton through the machine, and the second arm of the upper taping cartridge including a tape pressing member articulated thereto and under bias force applied thereto locating nested closely adjacent the forward side of said second arm when that arm is retracted but being opened away therefrom against said bias force by its pressing contact with the carton as it passes down onto the carton rear end as said second arm extends from retracted position, engagement of said pressing member with said carton rear end restraining return of said second arm to fully extended position until said pressing member moves down below the rear end of a first height range carton and such restraint is released whereby the second arm in moving to fully extended position propels said pressing member forwardly along the carton bottom at a speed greater than that of carton travel, said bias force urging said pressing member into tape pressing engagement with the carton bottom as said pressing member is being propelled forwardly.

2. The tape sealing machine of claim 1 in which the detector means comprises a switch disposed in the path of the advancing carton and actuated by engagement of the carton therewith, the means for vertically adjusting the space between the upper and lower taping cartridges comprising a power elevator connected with said upper taping cartridge, said switch controlling operation of said power elevator to move said elevator up and down relative to said lower taping cartridge.

3. The tape sealing machine of claim 2 further comprising a base, the base including a forwardly travelling conveyor on which the carton is received and advanced along a travel course through the machine, the lower taping cartridge being mounted on said base, the power elevator including a head beam in which the upper taping cartridge is carried, and a mast supporting the head beam for vertical movement thereon, the switch being carried on an end of the head beam.

4. The tape sealing machine of claim 3 further comprising power operated laterally adjustably movable carton embracing side rail means carried on said base and projecting alongside said conveyor.

5. The tape sealing machine of claim 4 in which operation of said switch additionally controls operation of the side rail means to laterally adjust said side rail means from laterally remote positioning thereof to carton embracing positioning at the sides of a carton to align it for entry onto said conveyor.

6. The tape sealing machine of claim 3 further comprising a second switch disposed downstream of the first-mentioned switch and controlled by carton movement on the conveyor and operable to disable the means for vertically moving the power elevator so that the head beam in an adjusted position corresponding to the detected height of a carton will remain in gravity imposed only support thereof on top of the carton as it advances through the machine.

7. The tape sealing machine of claim 6 further comprising control means disposed at the discharge end of said conveyor operable to power elevate said head beam a clearance distance above the carton upon completion of taping thereof so that said carton can off-feed unimpededly from the conveyor.

8. The tape sealing maohine of claim 2 in which the lower taping cartridge arm retraction means comprises a power operated retraction unit connected to one of the arms of that cartridge, and a control unit operating said retraction unit, said control unit being actuated by the power elevator whenever said power elevator is in a vertically adjusted location which corresponds to a detected carton height in said first range of carton heights.

9. The tape sealing machine of claim 1 in which the lower taping cartridge is disposed in the machine at a location downstream of that at which the upper taping cartridge is located, at least the first arm of the upper taping-cartridge when in extended position and the detected carton height is one within said first height range, disposing a distance below the carton travel course to position an initial length of the tape presented therewith to an advancing carton front end a corresponding distance below the carton travel course so that the engagement of the carton front end with that presented tape will be along a length part of that tape immediately above such initial length.

10. The tape sealing machine of claim 9 further comprising a plunger unit disposed below the carton travel course adjacent the disposition of the tape initial length when the said initial length is located below the carton travel course by the upper cartridge first arm, the plunger unit being forwardly strokable to engage the adhesive face of said tape initial length and hold same adhered thereto as the advancing carton engages the immediately above length part of said tape, the thereafter forward travel of the carton pulling said initial length free from the plunger so that said initial length subsequently may be lapped against the bottom of the carton.

11. The tape sealing machine of claim 10 further comprising a carton engageable control switch mounted downstream a distance from the entry of the carton onto the travel course, said control switch positioned such as to be actuated a delay time after the operation of said means for vertically adjusting the upper and lower cartridge spacing and by its actuation said control switch effecting forward stroking of said plunger unit from a set position thereof, during said time delay and where the detected carton height is one within said second height range, said vertically adjusting means positioning said upper taping cartridge relative to the carton travel course such that the said one arm thereof when extended does not dispose below the carton travel course, forward travel of the carton beyond said control switch deactivating said control switch whereby said plunger unit is returned to its set position.

12. The tape sealing machine of claim 1 in which the tape applying arms of each cartridge are mounted at a corresponding end of each on a pivot, the tape pressing member articulated to the second arm of said upper taping cartridge pair comprising an angularly profiled bracket having two adjacent leg parts, one leg part being pivoted to the other end of said second arm, the tip end of the other leg part carrying a carton engageable tape pressing device, corresponding other ends of the remaining cartridge arms carrying carton engageable tape pressing devices.

13. The tape sealing machine of claim 12 in which the tape pressing devices are rollers.

14. The tape sealing machine of claim 10 further comprising a cartridge engageable tape pressing component located downstream of the location of the upper taping cartridge and operable to press the initial length of tape against the bottom of the first height range carton.

15. The tape sealing machine of claim 1 in which the upper and lower taping cartridges each further includes a tape cutter normally biased to extend in a cutting direction into the carton travel course at a location intermediate the location of the associated cartridge arm pair when extended, the carton in its forward advance engaging the tape cutter to move it to a retracted position, advance of the carton out of engagement with the tape cutter releasing it so it can extend in a cutting direction to sever a length of tape from the associated tape stock.

16. Machine for tape sealing cartons of random heights which is any one in a first range of shorter heights and a seocnd range of taller heights while the cartons are advanced without stop along a forward travel course, the tape sealing of a shorter height carton being in a continuous wraparound tape run longitudinally of the carton from the top side to the bottom side of both the front and rear of said shorter height carton, the tape sealing of a taller height carton being in two separate continuous tape runs extending longitudinally of the carton one on the top side and down a distance on the front and rear ends thereof and the other on the bottom side and up a distance on the front and rear ends threof, the machine comprising upper and lower taping cartridges supported along the carton travel course, each cartridge including a pair of movably mounted tape applying arms having a normally extended position lying in the carton travel course, a first arm of each pair in extended position presenting the adhesive face side of pressure sensitive tape from a stock thereof in confrontation to the front end of an advancing carton so that the advancing carton can engage the tape to apply it to the carton front end and with its advance draw out tape run from the stock while additionally moving the first arm to a retracted position, the second arm of each pair being connected to its associated first arm to retract in tandem therewith, the first and second arms of the upper cartridge when retracted being in tape pressing contact with the top and those of the lower cartridge when retracted being in tape pressing contact with the bottom of the advancing carton, the upper and lower cartridge second arms when extending from their retracted positions pressing tape onto the carton rear end on forward pass by of the said rear end of the points where the retracted second arm of the respective pairs is in tape pressing contact with the carton top and bottom, means at the entrance to the carton travel course for detecting the height of a carton, means operable responsive to the detection of carton height to vertically adjust the spacing between the upper and lower taping cartridges in correspondence to the height of the carton, means operable whenever the detected carton height is one within said first height range to retract the arms of said lower taping cartrige to a position beyond taht which is caused by carton engagement with said arms whereby the arms of said lower cartridge locate in and maintain a carton non-engaging, non-taping mode during the passage of a first height range carton through the machine, and the second arm of the upper taping cartridge including a tape pressing member articulated thereto and under bias force applied thereto locating nested closely adjacent the forward side of said second arm when that arm is retracted but being opened away therefrom against said bias force by its pressing contact with the carton as it passes down onto the carton rear end as said second arm extends from retracted position, engagement of said pressing member with said carton rear end restraining return of said second arm to fully extended position until said pressing member moves down below the rear end of a first height range carton and such restraint is released whereby the second arm in moving to fully extended position propels said pressing member forwardly along the carton bottom at a speed greater than that of carton travel, said bias force urging said pressing member into tape pressing engagement with the carton bottom as said pressing member is being propelled forwardly, the effective lever length of said upper taping cartridge second arm and the tape pressing member articulated thereto being insufficient for said pressing member to move during second arm extension down below the bottom of a carton of a height in said second height range.

* * * * *